US007038703B2

(12) United States Patent
Ehrhardt

(10) Patent No.: US 7,038,703 B2
(45) Date of Patent: May 2, 2006

(54) LABEL PRINTER WITH LABEL EDGE DETECTOR

(75) Inventor: Robert Ehrhardt, Palatine, IL (US)

(73) Assignee: ZIH Corp., Hamilton (BM)

( * ) Notice: Subject to any disclaimer, the term of this patent is extended or adjusted under 35 U.S.C. 154(b) by 0 days.

(21) Appl. No.: 10/604,551

(22) Filed: Jul. 30, 2003

(65) Prior Publication Data

US 2005/0024409 A1 Feb. 3, 2005

(51) Int. Cl.
*B41J 2/315* (2006.01)
*B41J 2/32* (2006.01)

(52) U.S. Cl. ..... 347/171

(58) Field of Classification Search ..... 347/171–223
See application file for complete search history.

(56) References Cited

U.S. PATENT DOCUMENTS 4,685,815 A 8/1987 Baranyi
5,486,063 A 1/1996 Fox et al.
5,546,116 A * 8/1996 Nardone et al. ..... 347/218
5,978,004 A 11/1999 Ehrhardt ..... 347/171
6,027,265 A 2/2000 Parker et al. ..... 400/124.05
6,172,688 B1 1/2001 Iwasaki et al. ..... 347/2
6,314,054 B1 11/2001 Priebsch ..... 367/93
6,375,296 B1 4/2002 McGarry et al. ..... 347/13
6,421,073 B1 7/2002 Hauslaib et al.
6,634,818 B1 * 10/2003 Sato et al. ..... 400/624

OTHER PUBLICATIONS

International Search Report, EPO, mailed Jun. 12, 2004.

* cited by examiner

*Primary Examiner*—Stephen Meier
*Assistant Examiner*—Julian D. Huffman
(74) *Attorney, Agent, or Firm*—Alston & Bird LLP

(57) ABSTRACT

A label printer with a label edge sensor having a shortened measurement path through the supporting frame of the label printer. Linear and or angular movement of the print head as it encounters label edges is detected by sensors coupled to the printer frame. The sensor may be, for example, an optical, piezoelectric or position detecting transducer. In embodiments where the print head is rigidly coupled to a pivot that extends through the printer frame, the movement of the print head may be detected by a sensor located on the far side of the printer frame.

10 Claims, 5 Drawing Sheets

LABEL PRINTER WITH LABEL EDGE DETECTOR

BACKGROUND OF INVENTION

1. Field of the Invention

The present invention relates to thermal and thermal transfer label printers and, more specifically, to such printers adapted to printing on pressure sensitive adhesive-backed labels.

2. Description of the Prior Art

Thermal and thermal transfer printers are well known in the art. In thermal label printers, a web of pressure sensitive adhesive-backed labels, each having a thermally sensitized surface, is fed between a platen roller and a thermal print head. In a thermal transfer label printer, a transfer ribbon having a heat transferrable ink layer is additionally interposed between the print head and the label so that non-sensitized labels may be printed. The transfer ribbon is flexible and typically no thicker than ten microns Thus, the principles of the present invention are equally applicable to thermal and thermal transfer printers.

Pressure sensitive adhesive-backed labels for automated printing are typically presented in a continuous web. The web consists of a backing sheet of wax or silicone-impregnated paper approximately 0.0015" thick and having multiple labels of paper, polyester, synthetic paper, or similar material having a thickness between 0.0015" and 0.010" removably mounted thereon with a rubber or acrylic pressure-sensitive adhesive. Successive labels are separated by an interlabel gap, typically 0.125" wide, to which the printer is responsive for alignment of printing on the label. The web may be supplied from, for example, a roll or a fanfold.

In a friction fed thermal printer, deformation of the platen roller and slippage between the backing material and the platen introduce variability in the feed distance of the web per increment of platen shaft rotation. Slippage is a function of the web tension and produces a net loss in web advance, for example in an on-demand printer, when the printer advances a label against supply roll inertia to facilitate clearance from the printer for individual removal after printing and then backfeeds into a slack web before printing the next label.

Any error in web advance accumulates as successive labels are printed, resulting in progressive misregistration of the label image with respect to the label edges. A friction fed printer thus requires some means of sensing the edge of each label for synchronization in order to print multiple labels without manual intervention.

Label location in typical prior art thermal printers has been accomplished by measuring the optical transmissivity of the web. The backing is illuminated by a light source of known intensity, typically an infrared light-emitting diode. The amount of light passing through the backing between labels is greater than the light passing through the laminated backing and label. The transmitted light illuminates a photocell, which converts the changes in transmitted light to a varying electrical signal. The electrical signal can then be measured and interpreted as the label edge location by the printer's logic circuits and used to synchronize printing of each label.

However, optical sensors have inherent limitations. Even though the intensity of the light source is constant, the paper fibers in the label and in the backing produce fluctuations in the light intensity that may introduce errors into the edge determination. Because the light source and or optical sensors are proximate the media path, they may be fouled over time by fibers or other detritus continuously introduced into the media path by the media. Also, a transverse movement of the slack web perpendicular to its plane between the light source and the photocell may occur during backfeed, introducing an additional error.

The optical sensor is typically located an inch or more away from the heater elements to avoid mechanical interference with the print head or platen. If the web slips between the time the leading edge of a label passes the photocell and when it reaches the heater elements, or if slack develops between the photocell and the heater elements during backfeed, the printing will be misregistered on the label.

Applicant's U.S. Pat. No. 5,978,004 (Prior Art FIGS. 1–3) describes a label printer with a, for example, piezo-electric label edge sensor mounted on the print head or a bracket or support that carries the print head. This label edge sensor configuration advantageously allows direct sensing of the displacement caused by the arrival of each label edge at the print head. However, this configuration also has several limitations. First, signals from the sensor may have a poor signal to noise ratio due to support structure flexure and or external vibrations transmitted to the print head by the printer frame, print head pivot connection and or the print head spring. Second, if the print head spring strength and or spring mounting position(s) vary, the sensor response characteristics are changed. Further, use of different sized and or oriented labels, for example edge or center justified labels, may change the sensor response characteristics.

Competition in the market for label printers has focused attention on minimization of overall costs, including reduction of materials, manufacturing, operation and maintenance costs.

Therefore, it is an object of the invention to provide a system and method which overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
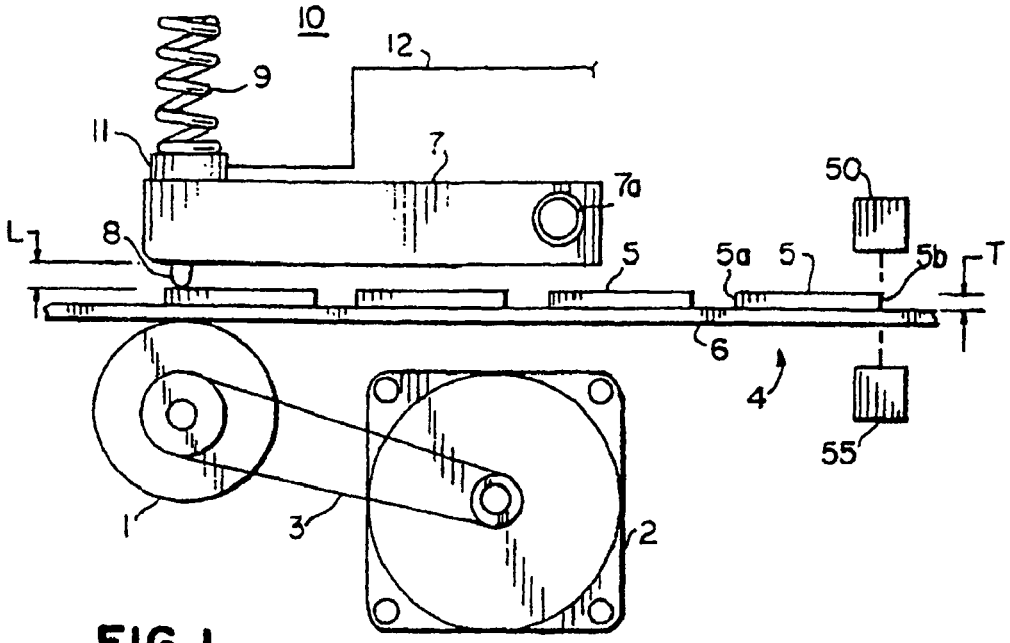
FIG. 1 is a side elevational view of a portion of a thermal printer in the prior art.
Figure 3:
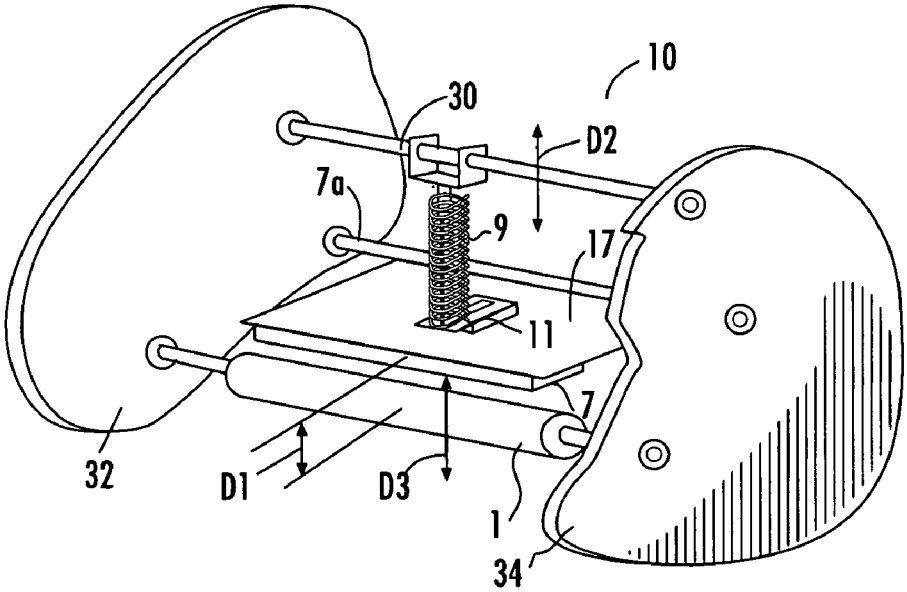
FIG. 3 is an isometric cut-away schematic view of a prior art thermal printer with a print head support and a piezo film bending arm sensor, portions omitted for clarity.

Applicant's prior U.S. Pat. No. 5,978,004, titled "Label Printer with Label Edge Sensor", issued Nov. 2, 1999 and hereby incorporated by reference in the entirety, describes a label printer 10. As shown in FIG. 1, a driving mechanism for the label printer 10 includes a platen roller 1, driven by a stepper motor 2 through, for example, a belt and pulley drive 3 to advance a label web 4 having a plurality of label(s) 5 removably positioned on a backing 6. A print head assembly includes a thermal print head 7 of a prior art type having a line of heater elements 8. The print head assembly is pivotably supported by a pivot 7*a* such that the heater elements 8 are aligned transverse to the motion of the web 4. The heater elements 8 are pressed against web 4 and web 4 against platen 1 by the action of a bias mechanism, for example a spring 9, through a pressure transducer or sensor 11, having a sensor output lead 12. While the print head 7 is shown as directly connected to the pivot 7*a* in FIG. 1, it may alternatively be carried by a pivot support bracket 17 connected to the pivot 7*a*, as shown in FIG. 3.

Each of the heater elements 8 has a dome-shaped tip and is of finite length L, the elements 8 forming a line of contact across web 4. Print head 7 is thus displaced (shown as D1 on FIG. 3) mechanically by the thickness T of labels 5 when the leading edge 5*a* or trailing edge 5*b* of each of label 5 passes under the heater elements 8.

The upward displacement D1 at each leading edge 5*a* against spring 9 through sensor 11 produces an increase in a sensor output signal on sensor output lead 12. Similarly, the downward displacement D1 at each trailing edge 5*b* results in a decrease in the sensor output signal on sensor output lead 12.

Figure 2:
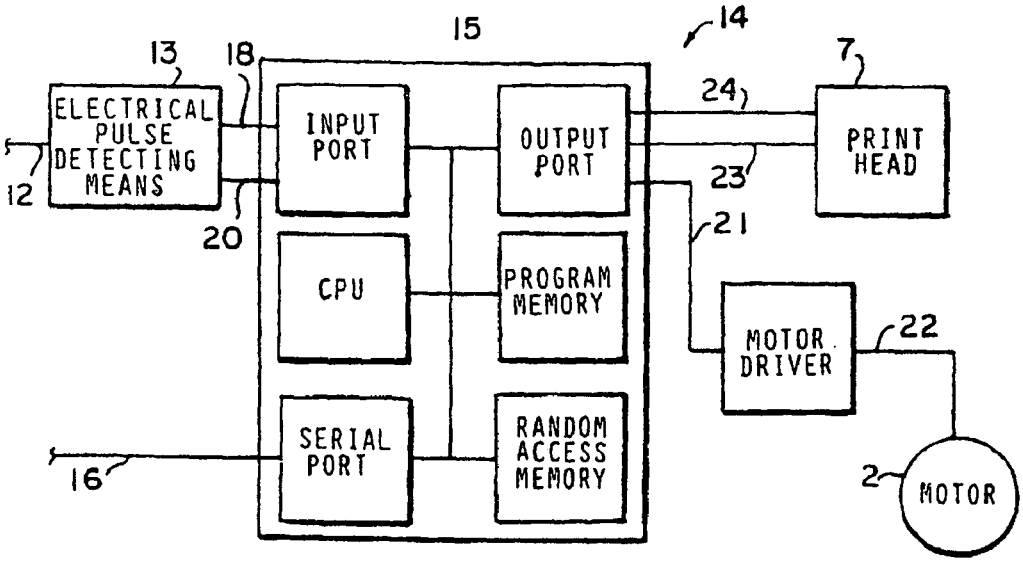
FIG. 2 is a partially schematic and partially functional block diagram of a microprocessor-based controller for the prior art printer of FIG. 1.

FIG. 2 is a diagram of one example of a controller 14 for the label printer 10. Controller 14 includes a microprocessor 15 having internal program memory, random access memory, a data input port, for example a serial port, responsive to a data input 16 for the receipt of information to be printed on a label 5, and input and output ports interconnected and operating in a manner well known in the art.

Controller 14 further includes a suitable electrical pulse detecting circuit 13 for detecting the sensor output signal on sensor output lead 12. The electrical pulse detecting circuit 13 generates a first output on the leading edge signal lead 18 in response to the increase in the sensor output signal on sensor output lead 12 when the leading edge 5*a* of label 5 passes under the heater elements 8. In a similar fashion, the negative pulse or change on sensor output lead 12 causes the circuit 13 to generate a second output on the trailing edge signal lead 20 when the trailing edge 5*b* of label 5 passes under the heater elements 8.

When a signal is received at data input 16 calling for a label to be printed, controller 14 begins pulsing output line 21 to motor driver 22 in order to advance stepper motor 2 until a leading edge 5*a* is detected and the leading edge signal lead 18 from circuit 13 is energized. Microprocessor 15 then loads into print head 7 data 23 representing the heaters to be energized and energizes the selected heaters by pulsing strobe 24 to print the first row of dots. It then pulses output line 21 to motor driver 22 again to advance web stepping motor 2 by one dot row and then repeats the printing process. This process continues until the trailing edge signal lead 20 from circuit 13 is energized, signaling the end of the label 5, at which time controller 14 ceases printing and performs a printed label forward feed and then back feed label ejection sequence and or awaits the request for the next label.

The pressure transducer or sensor 11 could be of any of a number of different types, for example a piezoelectric transducer. Piezoelectric transducers formed of any of a number of different materials could be used, for example a lead zirconate titanate material of the type sold by Morgan Matroc, Inc. under the designation PZT-5A. Piezoelectric transducers are available in any of a number of different physical configurations and may be configured in multiple transducer stacked configurations to form a single sensor with increased signal response levels. Another suitable piezo material, useful for forming sensors responsive to bending, is available from Measurement Specialties, Inc. under the designation LDT0-028K/L.

A prior-art type of optical medium light emitter 50 and detector 55 pair (see FIG. 1) may be added to the label printer 10, to detect a label-out condition, which might otherwise be difficult to positively detect using only a sensor 11.

Applicant's research has revealed that, in each of the prior configurations, the signal generated by the sensor 11 may be degraded by additional displacements, vibrations and or noise introduced by the presence of an extended measurement path through the supporting structure of the label printer 10 against which the displacement D1 occurs.

For example, as shown by FIG. 3, a toggle bar 30 supporting the spring 9 may be subject to a bending motion and or vibration, identified as D2. Similarly, the platen roller 1 may have a bending motion or vibration, identified as D3. Also, the main frame 32 and or side frame 34 of the label printer 10 may introduce vibrations external to the label printer 10 into the measurement path.

Applicant's U.S. Pat. No. 5,978,004 also recognized that bending motions on thin piezoelectric elements produces a positive voltage when bent in a first direction and a negative voltage when bent in a second direction. However, use of the sensor 11 to detect a bending motion was directed to detection of the bending of an arm formed between a first connection point of the spring 9 on the print head support bracket 17 and a second connection point of the print head 7 to the print head support bracket 17. This configuration results in the same extended measurement path and associated signal degradation described above.

Figure 4:
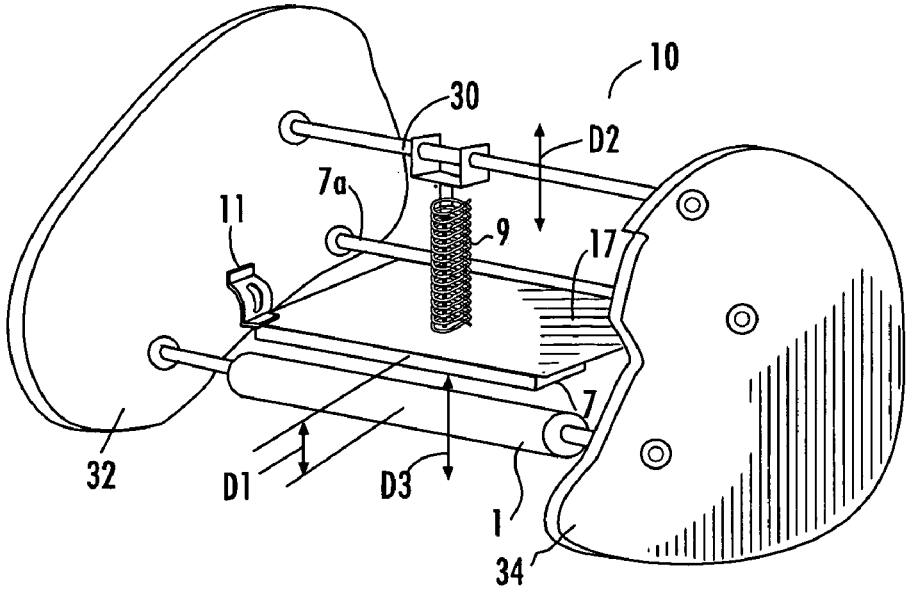
FIG. 4 is an isometric cut-away schematic view of a label printer, portions omitted for clarity, according to an embodiment of the present invention.

By reconfiguring the sensor 11 location, type and or connection points, thereby reducing the measurement path, the signal to noise ratio of the sensor 11 output is significantly improved. As shown by FIG. 4, a sensor 11 may be connected between the print head 7 or print head support bracket 17 and the main frame 32, arranged to bend in response to the linear displacement D1. Because the mounting point of the sensor 11 to the main frame 32 is proximate to the connection point of the platen roller 1 to the main frame 32 any error introduced by D2 and or variance in the spring 9 is eliminated and the measurement path overall significantly shortened. Alternatively, the sensor 11 may be mounted to the other end of the printhead 7 or print head support bracket 17 and connected to the side frame 34.

Figure 5:
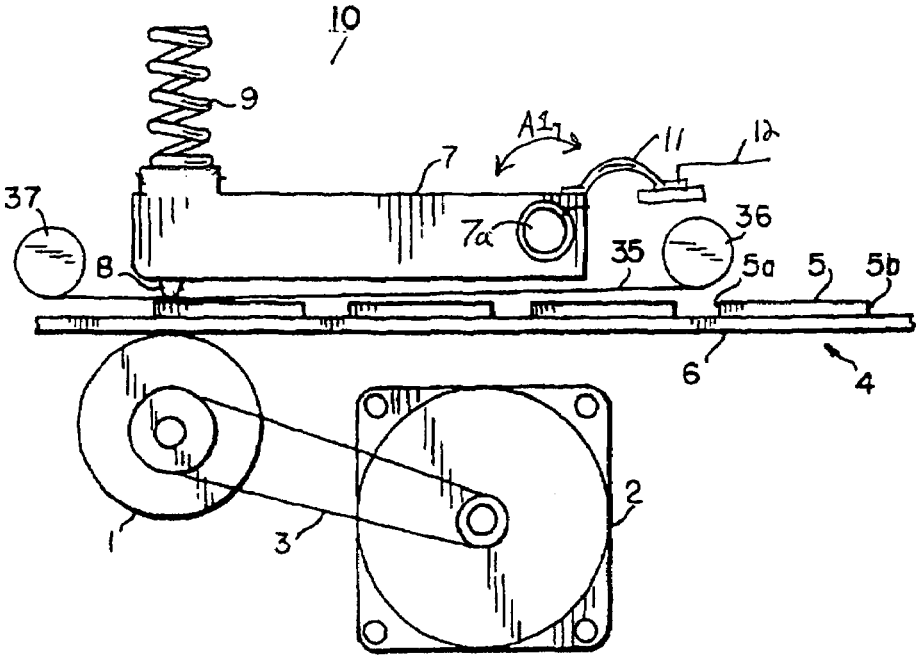
FIG. 5 is a side elevational view of a portion of a thermal printer, according to another embodiment of the present invention.

In FIG. 5, the printer 10 uses a thermal transfer ribbon 35. A supply roll 36 supplies the thermal transfer ribbon 35 along the media path between the heater element(s) 8 and the label 5. A thermally sensitive coating of the thermal transfer ribbon 35 is thereby transferred to the label(s) 5 under the control of the microprocessor 35, as described above with respect to a thermal printer. Used thermal transfer ribbon 35 may be collected by a take-up roll 37. One skilled in the art will appreciate that sensor 11 arrangements described herein are applicable to both thermal and thermal transfer type label printers.

Where the print head 7 is arranged in a pivoting orientation, as the print head 7 is displaced by D1, a corresponding angular rotation A1 of the print head 7 and or print head support bracket 17 about the center of rotation, for example pivot 7*a*, also occurs. Therefore, measurement of angular rotation A1 may also be used to detect arrival of a label 5 edge at the heater elements 8. As shown in FIG. 5, mounting the sensor 11 so that it will bend according to angular rotation A1 is another way to accurately detect a label edge, without introducing the effects of an extended measurement path and or degradation of the signal due to D2.

Figure 6:
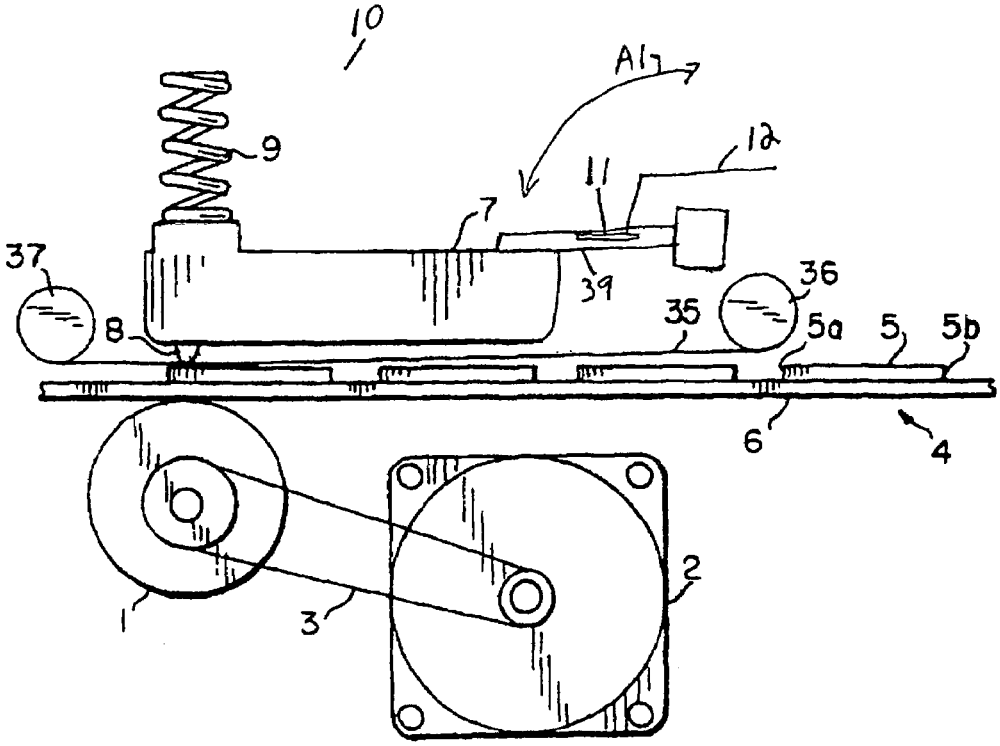
FIG. 6 is a side elevational view of of a portion of a thermal printer, according to another embodiment of the present invention.

As shown by FIG. 6, the print head 7 mounting assembly may be simplified by replacing the rotatable connection to the pivot 7*a* with a bending member 39. The sensor 11 may be then be mounted to or incorporated with the bending member 39. The bending member 39 may be connected to a fixed portion of the printer 10 frame so that angular rotation A1 of the print head 7 bends the bending member 39 and thereby activates the sensor 11.

Figure 7:
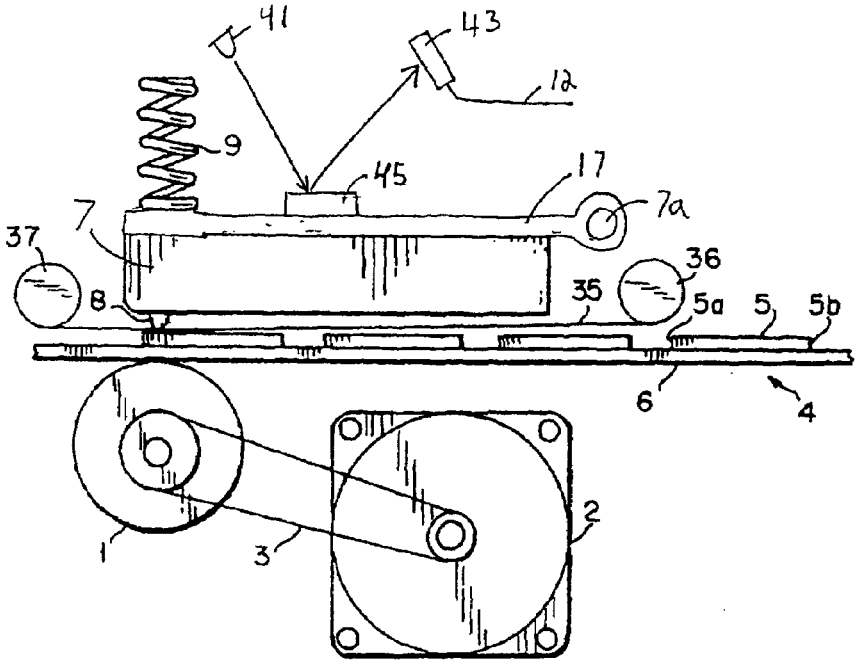
FIG. 7 is a side elevational view of a portion of a thermal printer, according to another embodiment of the present invention.

The sensor 11 is not limited to pressure and or piezoelectric transducers. For example, as shown by FIG. 7, a frame mounted light emitter 41 and light detector 43 pair may be used with a reflector 45 mounted on the print head 7 or print head support bracket 17 to provide the same function as the sensor 11. Motion of the reflector 45 in the direction D1 and or angular rotation A1 will interrupt the alignment of the light emitter 41 and light detector 43. Thereby, a change in the reflected light location, color, polarization angle and or intensity can be detected by the light detector 43 which will increase or decrease a corresponding signal in the sensor output lead 12. Because the light emitter 41 and light detector 43 may be mounted to common portions of either the main frame 32 or side frame 34 the measurement path between them may be extremely short providing an improved signal to noise ratio. Further, because the light emitter 41, reflector 45 and light detector 43 are mounted outside of and above the media path, they are less susceptible to the fouling associated with optical sensors reading through the label web 4.

Figure 8:
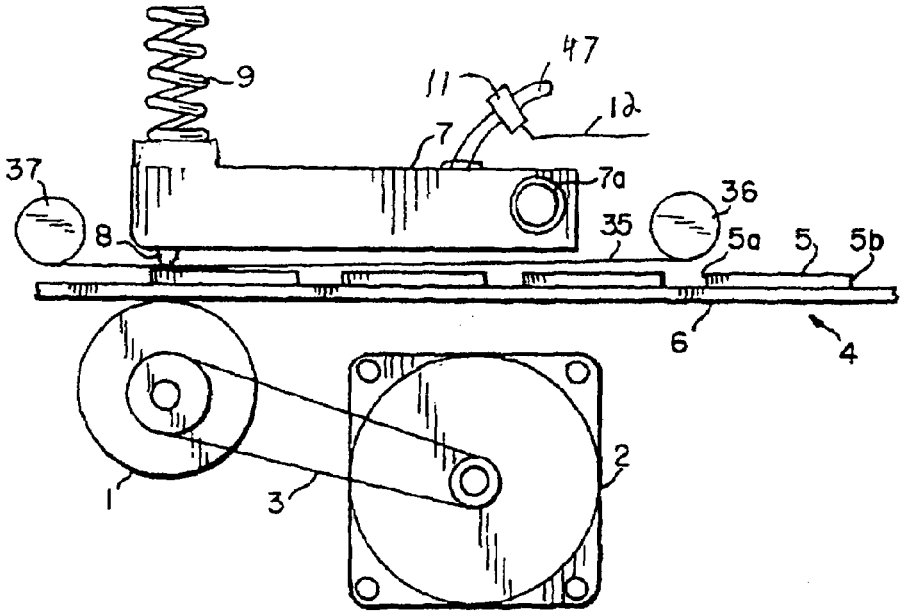
FIG. 8 is side elevational view of a portion of a thermal printer, according to yet another embodiment of the present invention.

Another form of sensor 11 is shown in FIG. 8. Here the sensor 11 is a position sensor mounted on the main frame 32 or side frame 34 and arranged to detect changes in the print head 7 linear position along D1 and or angular position along A1. The sensor 11 may read the position of a separate sector member 47 mounted on the print head 7 (or print head support member 17) or a similar graduation formed in a side of the print head 7 and or print head support member 17. In this embodiment the measurement path is also shortened and any influence from toggle bar 30 movement D2 removed.

Figure 9A:
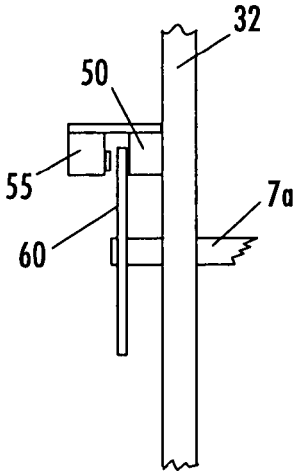
FIG. 9*a* is a front elevational view of a thermal printer sensor arrangement located on a far side of a printer frame, according to another embodiment of the present invention.
Figure 9B:
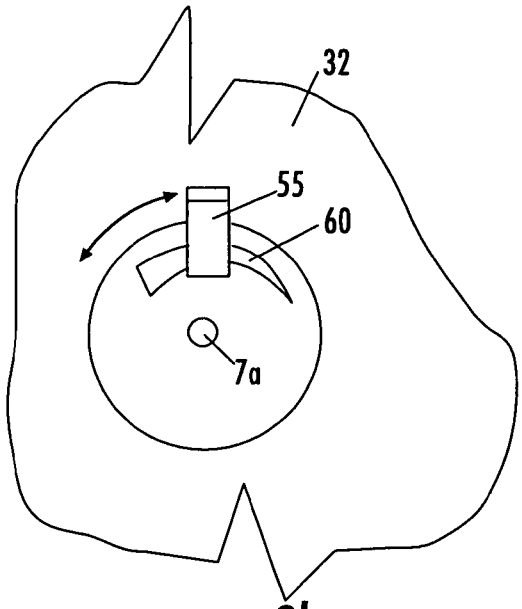
FIG. 9*b* is a side elevational view of the thermal printer sensor arrangement of FIG. 9*a*.
Figure 10A:
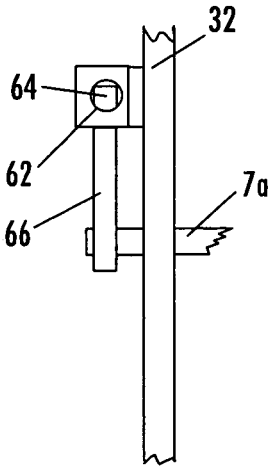
FIG. 10*a* is a front elevational view of a thermal printer sensor arrangement located on a far side of a printer frame, according to another embodiment of the present invention.
Figure 10B:
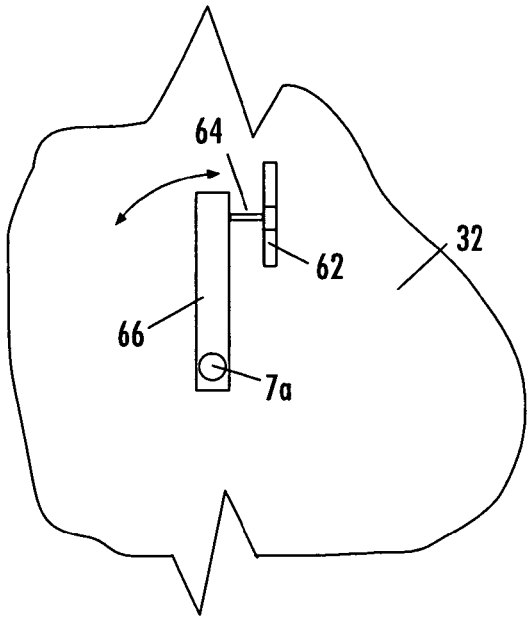
FIG. 10*b* is a side elevational view of the thermal printer sensor arrangement of FIG. 10*a*.

To further isolate the selected sensor 11 arrangement from fouling or mechanical damage that might occur during media exchange or other printer servicing, a rigid connection between the pivot 7*a* and print head 7 and or print head support bracket 17 may be made. The selected sensor 11 may then be coupled to the pivot 7*a* on the far side of the mainframe 32 or side frame 34 and the angular rotation A1 of the printhead 11 detected. As shown for example in FIGS. 9*a* and 9*b*, a variable area mask 60 coupled to the pivot 7*a* will reduce the light from a light emitter 50 arriving at a detector 55 in response to movement of the printhead 7 across a label 5 leading or trailing edge 5*a*, 5*b*. Similarly, as shown in FIGS. 10*a* and 10*b*, an electrical position sensor 62, for example a linear voltage displacement transducer, may sense a target probe 64 attached to an arm extending from the pivot 7*a*. Gain in each of these sensor 11 arrangements can be increased, for example, by increasing the distance of the target probe 64 and or location of the variable area mask 60 from the center of rotation of the pivot 7*a*. One skilled in the art reviewing this description will appreciate that the position and or bending arm sensor 11 arrangements as described herein above may also be adapted for placement on the far side of the mainframe 32 or side frame 34 with similar sensor isolation benefits.

In each of the embodiments described herein, the signal to noise ratio of the resulting signal in the sensor output lead 12, corresponding to the passage of a label leading edge 5*a* or label trailing edge 5*b* past the heating elements 8 is improved. Also, because the measurement path in each of the embodiments is shortened, the prior supporting structure and strength of materials for the toggle bar 30, main frame 32 and or side frame 34 may reduced, improving overall label printer 10 manufacturing and cost of materials efficiencies.

Table of Parts

| | |
|---|---|
| 2 | stepper motor |
| 3 | drive |
| 4 | label web |
| 5 | label |
| 5a | leading edge |
| 5b | trailing edge |
| 6 | backing |
| 7 | printhead |
| 7a | pivot |
| 8 | heater elements |
| 9 | spring |
| 10 | label printer |
| 11 | sensor |
| 12 | sensor output lead |
| 13 | electrical pulse detecting circuit |
| 14 | controller |
| 15 | microprocessor |
| 16 | data input |
| 17 | print head support bracket |
| 18 | leading edge signal lead |
| 20 | trailing edge signal lead |
| 21 | output line |
| 22 | motor driver |
| 23 | data |
| 24 | strobe |
| 30 | toggle bar |
| 32 | main frame |
| 34 | side frame |
| 35 | thermal transfer ribbon |
| 36 | supply roll |
| 37 | take-up roll |
| 39 | bending member |
| 41 | light emitter |
| 43 | light detector |
| 45 | reflector |
| 47 | sector member |
| 50 | light emitter |
| 55 | light detector |
| 60 | variable area mask |

-continued

| Table of Parts | |
|---|---|
| 62 | electrical position sensor |
| 64 | target probe |
| 66 | arm |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A label printer for printing on labels spaced longitudinally along a carrier web with each label having a predetermined thickness and a leading edge and a trailing edge, the printer comprising:

a driving mechanism for advancing the carrier web along a media path;

a frame;

a thermal print head assembly supported by the frame, wherein the thermal print head assembly is mounted to the frame for movement toward and away from the carrier web and includes a line of heater elements aligned transverse to the direction of travel of the carrier web;

a bias mechanism urging the print head toward the web so that the heater elements are pressed against the web;

a motion sensor for sensing a displacement of the thermal print head assembly as edges of the labels pass beneath the heater elements; and a controller responsive to the motion sensor for synchronizing printing with the edges of each label, wherein the motion sensor is rigidly coupled to the frame at a first end, wherein the thermal print head is rigidly coupled to a pivot which extends through the frame, wherein the motion sensor is responsive to angular displacement of the pivot, wherein the motion sensor is an arrangement including a light emitter and a detector, and wherein the light emitter and the detector are separated by a variable area mask coupled to the pivot.

2. A label printer for printing on labels spaced longitudinally along a carrier web with each label having a predetermined thickness and a leading edge and a trailing edge, said printer comprising:

a driving mechanism for advancing the web along a path;

a frame;

a print head support mounted to said frame for movement toward and away from the web;

a thermal print head carried by said support for movement therewith and including a line of heater elements aligned transverse to the direction of travel of the web;

a bias mechanism urging the print head support toward the web so that the heater elements are pressed against the web;

a motion sensor carried by the support for sensing displacement of the thermal print head as edges of the labels pass beneath the heater elements; and a controller responsive to the motion sensor for synchronizing printing with the edges of each label, wherein the motion sensor is rigidly coupled to the frame at a first end, wherein the print head support is rigidly coupled to a pivot which extends through the frame, wherein the motion sensor is responsive to angular displacement of the pivot, wherein the motion sensor is an arrangement including a light emitter and a detector, and wherein the light emitter and the detector are separated by a variable area mask coupled to the pivot.

3. A printer for printing on media spaced longitudinally along a carrier web having leading edges, the printer comprising:

a driving mechanism for advancing the carrier web along a media path;

a frame;

a thermal print head assembly supported by said frame, the thermal print head assembly mounted for movement toward and away from the carrier web;

a pivot connected to the frame of said thermal print head assembly; and a sensor for sensing a displacement of the thermal print head assembly as edges of the media pass beneath the print head, wherein the sensor is a position sensor connected to the frame, wherein the sensor is an arrangement comprising a light emitter and a detector, and wherein the light emitter and the detector are separated by a variable area mask coupled to the pivot.

4. The printer of claim 3, wherein the media has a leading edge, said printer further comprising a controller responsive to the sensor for synchronizing printing with the edge of each media.

5. The printer of claim 3 further comprising a bias mechanism urging the print head toward the web so that the print head is pressed against the web.

6. A printer for printing on media spaced longitudinally along a carrier web, the printer comprising:

a driving mechanism for advancing the carrier web along a media path;

a frame;

a thermal print head assembly supported by said frame, the thermal print head assembly mounted for movement toward and away from the carrier web;

a sensor in communication with said thermal print head assembly for sensing a displacement of the thermal print head assembly due to the passage of the media beneath the print head, wherein the sensor arrangement comprises a light emitter and detector; and a pivot connected to the frame of said thermal print head assembly, and wherein the light emitter and the detector are separated by a variable area mask coupled to the pivot.

7. The printer of claim 6, wherein said position sensor is connected to the frame.

8. The printer of claim 6, wherein the media comprises labels adhered to the carrier web and wherein said sensor senses displacement of the thermal print head assembly due to contact of the thermal print head assembly with edges of the labels.

9. The printer of claim 6, wherein the media has a leading edge, said printer further comprising a controller responsive to the sensor for synchronizing printing with the edge of each media.

10. The printer of claim 6 further comprising a bias mechanism urging the print head toward the web so that the print head is pressed against the web.

* * * * *